US007510025B2

(12) United States Patent
Davies

(10) Patent No.: US 7,510,025 B2
(45) Date of Patent: Mar. 31, 2009

(54) BORING MACHINE

(76) Inventor: Rodney John Davies, 47 Brunel Road, Seaford, Victoria 3198 (AU)

( * ) Notice: Subject to any disclaimer, the term of this patent is extended or adjusted under 35 U.S.C. 154(b) by 0 days.

(21) Appl. No.: 11/566,306

(22) Filed: Dec. 4, 2006

(65) Prior Publication Data

US 2007/0089906 A1 Apr. 26, 2007

Related U.S. Application Data

(63) Continuation-in-part of application No. 10/622,710, filed on Jul. 18, 2003, now abandoned.

(30) Foreign Application Priority Data

Dec. 5, 2002 (AU) ..... 2002953110

(51) Int. Cl.
*E21B 44/00* (2006.01)
*E21D 9/093* (2006.01)
*E21D 9/10* (2006.01)

(52) U.S. Cl. ..... 175/26; 299/81.2; 299/1.3; 299/1.8; 299/58; 405/142; 405/143

(58) Field of Classification Search ..... 175/26, 175/45; 299/81.2, 1.3, 1.8, 55, 58; 405/142, 405/143
See application file for complete search history.

(56) References Cited

U.S. PATENT DOCUMENTS

| | | | | |
|---|---|---|---|---|
| 1,026,412 | A | | 5/1912 | Stone |
| 3,005,627 | A | * | 10/1961 | Tinlin ..... 299/56 |
| 3,321,248 | A | | 5/1967 | Williamson et al. |
| 3,635,108 | A | | 1/1972 | Prince |
| 3,707,330 | A | | 12/1972 | Pine |
| 3,778,107 | A | | 12/1973 | Haspert |
| 3,799,615 | A | | 3/1974 | Taylor et al. |
| 4,023,861 | A | | 5/1977 | Schnell |
| 4,027,210 | A | | 5/1977 | Weber |
| 4,122,683 | A | | 10/1978 | Follert et al. |
| 4,494,617 | A | | 1/1985 | Snyder |
| 4,506,745 | A | | 3/1985 | Bjor |
| 4,556,256 | A | | 12/1985 | Follert et al. |
| 4,576,515 | A | | 3/1986 | Morimoto et al. |

(Continued)

FOREIGN PATENT DOCUMENTS

| | | |
|---|---|---|
| DE | 3203924 | 8/1983 |

(Continued)

*Primary Examiner*—Shane Bomar
(74) *Attorney, Agent, or Firm*—Smith-Hill & Bedell, P.C.

(57) ABSTRACT

A micro tunnelling machine has a tunnelling head with a boring bit which is forced in a horizontal direction by a hydraulic thruster. The direction of the head is laser guided. The beam strikes a target in the head and a camera relays an image of the target to an operator located at the tunnel entrance. The operator adjusts the direction by admitting water and draining water from a pair of rams inside the head which move the boring bit up and down or left and right. Water is introduced into the boring bit through the drive shaft of the boring bit. The water forms a slurry which is extracted by a vacuum pipe which enters the slurry as droplets and particles and conducts them away from the tunnelling head.

16 Claims, 5 Drawing Sheets

U.S. PATENT DOCUMENTS

| | | | | |
|---|---|---|---|---|
| 5,076,729 | A | 12/1991 | Grotenhofer | |
| 5,099,927 | A | 3/1992 | Gibson et al. | |
| 5,133,418 | A | 7/1992 | Gibson et al. | |
| 5,156,490 | A | 10/1992 | Terasawa | |
| 5,172,764 | A * | 12/1992 | Hajali et al. | 166/267 |
| 5,236,284 | A | 8/1993 | Ilomaki | |
| 5,296,915 | A | 3/1994 | Akesaka | |
| 5,361,854 | A | 11/1994 | Tull et al. | |
| 5,470,132 | A | 11/1995 | Cartwright | |
| 5,501,548 | A | 3/1996 | Hayashi et al. | |
| 5,529,437 | A | 6/1996 | Filipowski et al. | |
| 5,890,771 | A | 4/1999 | Cass | |
| 5,938,288 | A | 8/1999 | Saint-Pierre et al. | |
| 6,017,095 | A | 1/2000 | DeMillo | |
| 7,073,869 | B2 * | 7/2006 | Nakakuro | 299/81.3 |
| 2006/0102565 | A1 * | 5/2006 | Alford | 210/770 |

FOREIGN PATENT DOCUMENTS

| | | |
|---|---|---|
| JP | 2000328876 | 11/2000 |

* cited by examiner

BORING MACHINE

CROSS REFERENCE TO RELATED APPLICATION

This application is filed as a continuation-in-part of U.S. patent application Ser. No. 10/622,710 filed Jul. 18, 2003, now abandoned the entire disclosure of which is hereby incorporated by reference herein, and claims priority under 35 USC 119 of Australian Provisional Application No. 2002953110 filed Dec. 5, 2002.

FIELD OF THE INVENTION

This invention concerns micro-tunnelling machines of type used to bore underground drainage passages.

BACKGROUND OF THE INVENTION

Infill housing frequently requires the provision of services which cross boundaries and which must be precisely located. When the drainage is one of the services, the fall or incline must be incorporated into the final selected direction. Additionally, where line of sight is available to find the radial angle from the bore entrance to the target site, optical instruments provide accuracy. If an obstruction is encountered, an excavation may be needed to investigate. Alternatively the change in direction is planned. Every effort is made to reduce the expensive boring stage to a minimum. The use of laser technology by drainers is well established, but laser guided micro-tunnelling machines are expensive and not widely used.

U.S. Pat. No. 3,857,449 discloses a pipe thruster which uses a laser beam as a directional reference. The guidance system relies upon detecting the deviation of the machines thrust axis from the optical path of the beam.

Australian Patent No. AU-A-12360/88 describes a guidance control system for a laser guided boring machine for boring underground drains. The laser target has five light sensitive portions which emit voltages which when amplified are compared to predetermined threshold values and an output signal actuates a pair of 24v motors. The motors drive linear actuators which adjust the direction of the boring bit.

Trials and contract boring show that if the electronic components of the device fail, they tend to do so in locations where service and repair is slow or unavailable. It has also been found that when the strata are uniform, surprisingly infrequent corrections are required in practice, but this was only discovered when a non-automatic version was constructed and tested.

SUMMARY OF THE INVENTION

The apparatus aspect of this invention provides a guidance system for the boring head of a micro-tunnelling machine of the type which bores in a selected direction and inclination using laser beam guidance having the endmost part of the drive to the boring bit adjustable in two directions at 90° wherein, The endmost part of the drive has a target for the laser beam, means to convey an image of the target and the laser strike position thereon to an operator situated remotely from the boring head and input means for the operator to adjust the direction of the endmost part of the drive.

Means to convey the image may be a video camera. The target may be a surface against which the laser can be seen in contrast. The target may have a series of concentric rings, cross hairs or equivalent markings to help the operator to centre the direction of the boring bit.

The video camera may supply a continuous signal to a monitor at the bore entrance or at a convenient location. It is usual for the operation to require the presence of an operator to add drive extensions to the bore string. It is therefore economic to have the operator guide the bit in between intermittent string extensions. During the fitting of an add-on drive unit, the bit is not revolving.

The input means for the operator may be switches which control the adjustors which act on the drive shaft mutually at 90°. The switches may be individual, but preferably they are grouped together as slide controls, but more preferably as a joystick.

The adjustment of drive shaft direction may be achieved by hydraulic pressure supplied by the water feeding the flushing operation of the boring bit.

Control of waterflow to the hydraulics may be by solenoid operated valves. This is convenient if the hydraulic rams and the valves are grouped together in the boring head making it necessary to supply the head with a water feed conduit, low voltage electrical leads and a large bore slurry removal conduit. The moving parts may therefore be reduced to the drive shaft, the associated rams and the boring bit. This layout simplifies and cheapens the construction of the machine. It is not onerous to watch the monitor and correct the direction of the bore intermittently. Once aligned, the bore tends to maintain course unless changes in the subsoil occur. The machine's static base is installed in the pit and its radial direction, ie. NSEW, is selected and thereafter the frame is locked in position. The sliding frame assumes the direction of the static base. The direction of the thrust imposed on the boring head is unchanged during the addition to the string of the add-on drive sections.

BRIEF DESCRIPTION OF THE DRAWINGS

One embodiment of the invention is now described by way of example with reference to the accompanying drawings, in which.

DETAILED DESCRIPTION

Figure 1:
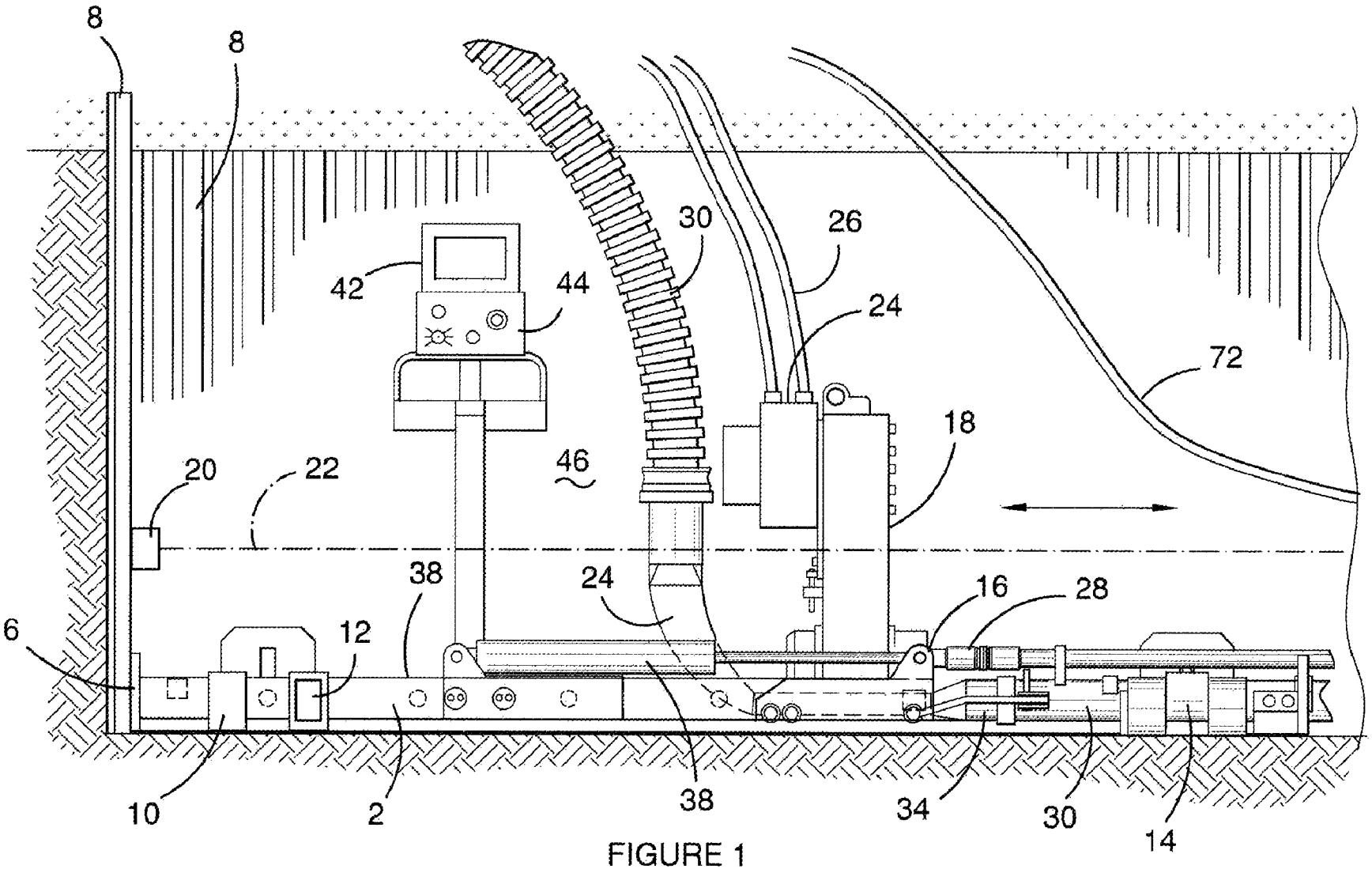
FIG. 1 is a side view of the machine.

Referring now to the drawings, once the main excavation and the target excavation have been made the direction and depth of the bore is established by drain laying practice. The main excavation pit accommodates the steel rails 2 of the base frame 4. The rails 2 are joined by brace 6 which contacts the steel plate shuttering 8 lining the pit. The base frame has lugs 10 which extend on both sides toward the side of the pit and jacks 12 are inserted to position the frame radially. In addition, the base frame has a ground jack 14 to adjust its inclination. Once installed and adjusted, the rails remain static.

A sliding frame 16 engages the rails. The sliding direction conforms to the direction of the base frame and therefore is aligned with the bore path. A retractable drilling assembly 18 (FIG. 1) is fixed to the sliding frame 16. A laser generator 20 is mounted on the steel plate 8 just above the base frame 4. The laser beam 22 is adjusted to reach the required point at the target site. This arrangement is standard drain layer's technology.

The assembly 18 has a hydraulic motor 24 which is driven by a supply located near the pit through conduits 26. The motor drives a shaft coupling 28 which is located above the vacuum pipe 30, which discharges the slurry from the boring operation to a large capacity, vacuum vessel 32 (80001) (see FIG. 6) brought to the site on a truck (not shown). The vacuum pipe coupling 34 lies alongside the drive coupling 28.

Figure 2:
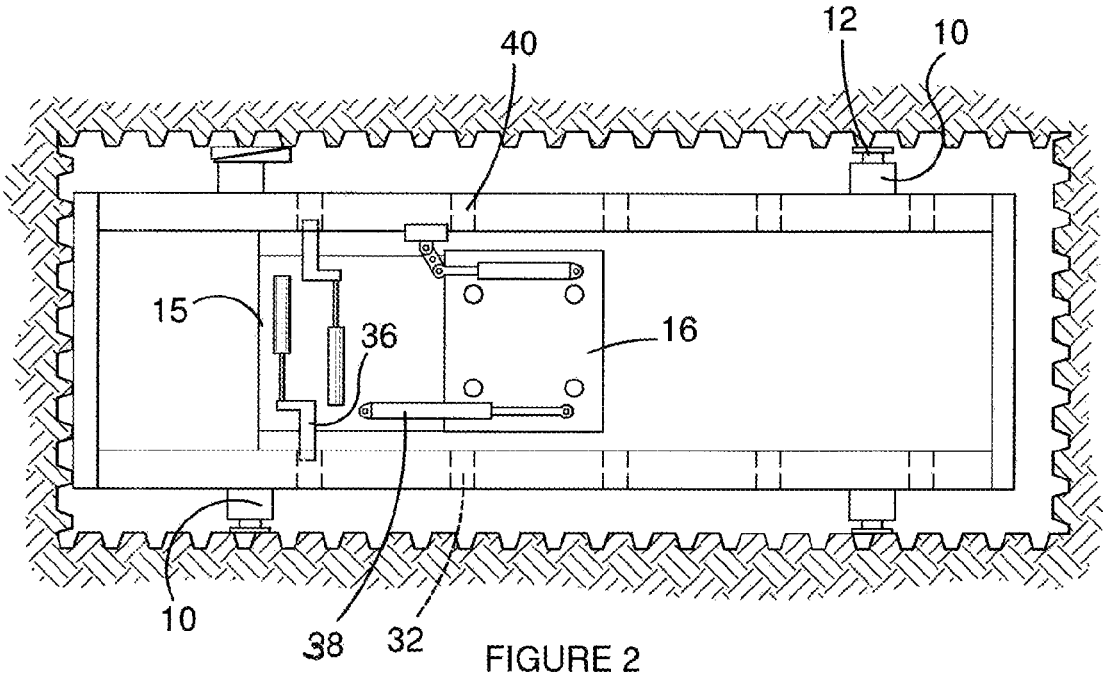
FIG. 2 is a plan of the base and the slidable frame.

A pair of double acting feed rams 38 connected between the base frame 4 and the sliding frame 16 push the drilling assembly 18 in the feed direction and retract it to the START position. The sliding frame 16 is locked in position in the base frame 4 by locking pins 36 (see FIG. 2) which enter bores 40 in the rails 2. Frame 15 is locked to the rearmost notch with the L-pins. A drill string set is coupled between frame 16 and the mouth of the bore. Ram 28 drives the whole string and the bore head forward a yard. The L-pins unlock. Rams 38 work in reverse pulling frame 15 closer to the bore. L-pins engage the next notch. The next string is inserted. Rams 38 push frame 16 another yard. In this way frames 15 and 16 "walk" towards the bore. When the passages are close to the bore, the L-pins are unlocked and the carriage is pushed back to the start. A video monitor 42 and a control console 44 are mounted on part of the sliding frame 16 in front of the operators space 46.

Figure 4:
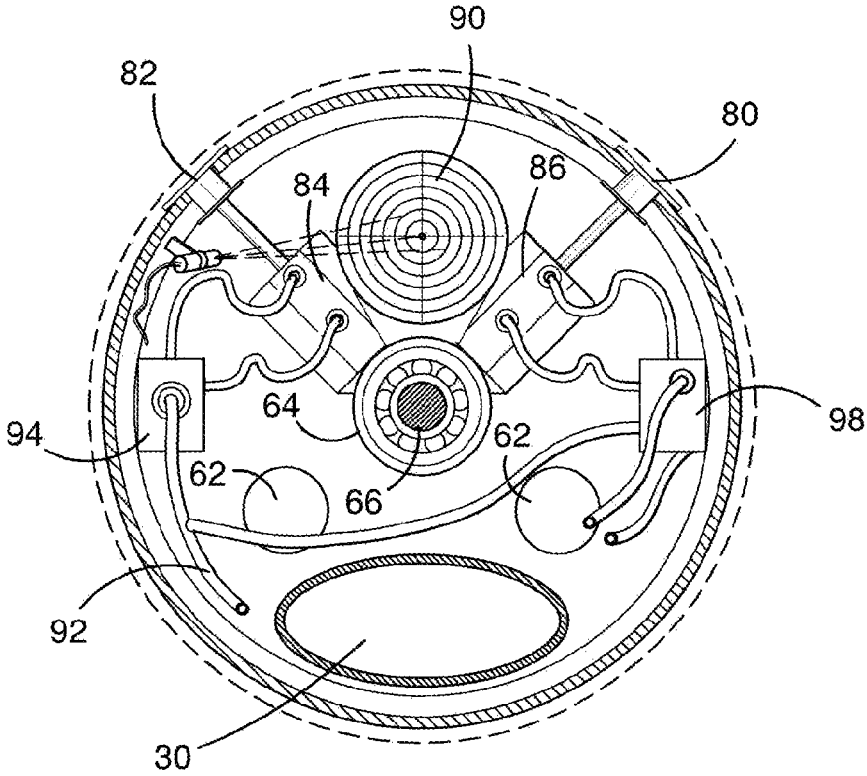
FIG. 4 is an end section of the boring head in FIG. 3.
Figure 3:
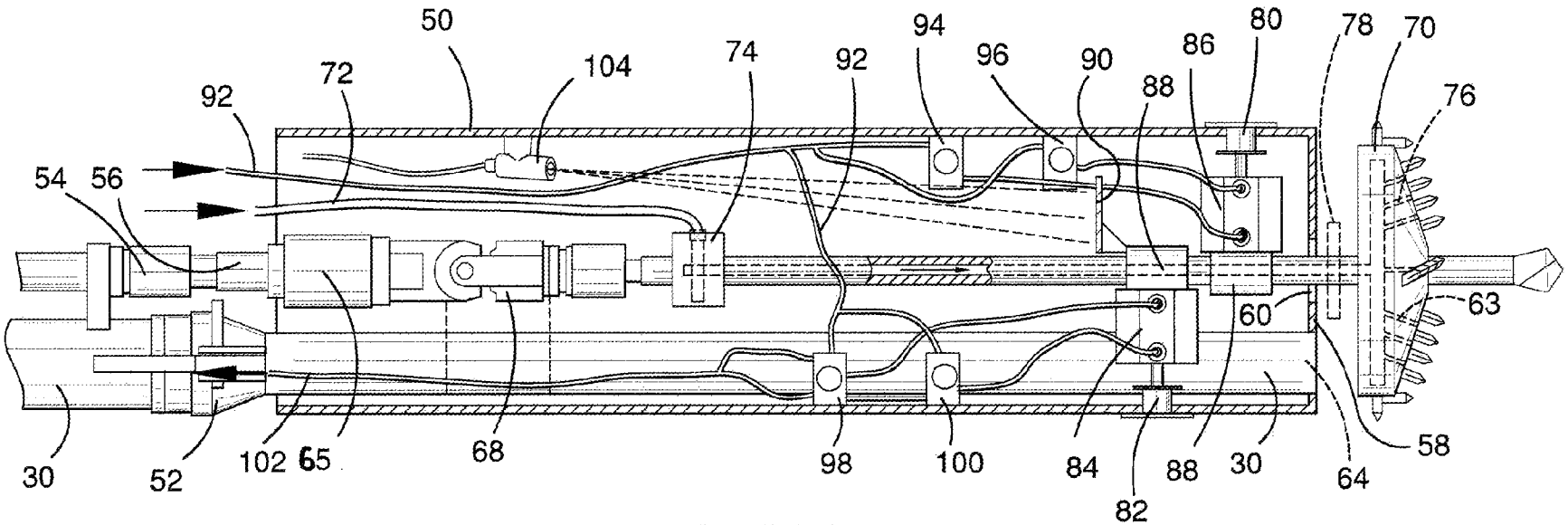
FIG. 3 is a side sectional view of the boring head.
Figure 5:
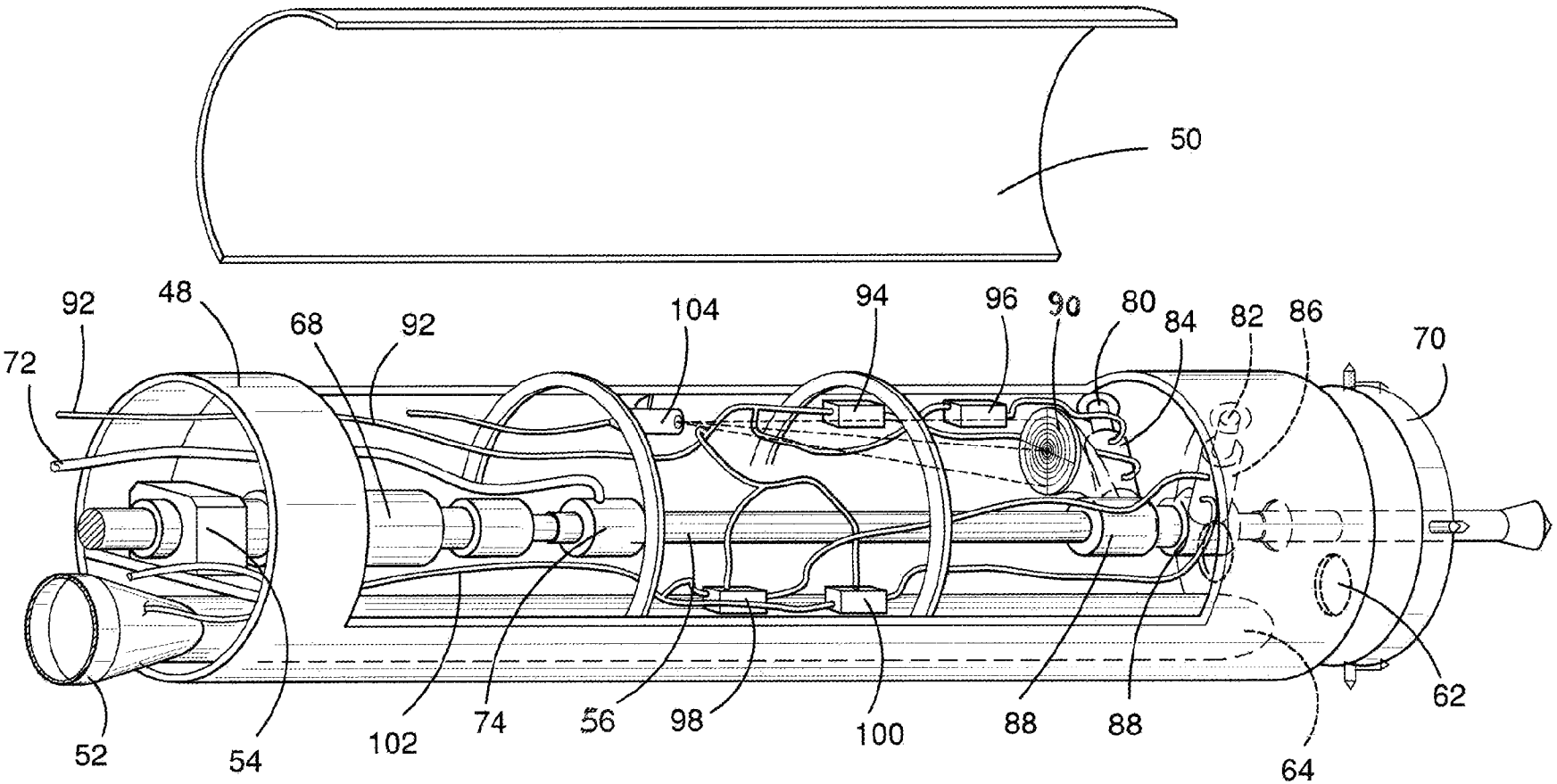
FIG. 5 is a cut away view of the head shown in FIG. 3.

Referring now to FIGS. 3, 4 and 5, the boring head comprises a cylindrical, steel plate shell 48 which has a removable cover 50. The boring head is from 300 to 650 mm (preferably from 330 to 480mm) in diameter. The trailing end has a union 52 for the vacuum pipe 30 and a union 54 for the drive shaft 56 which couple to the corresponding parts on the sliding frame 16 and to the add-on extension units (not shown) which drainage contractors utilise in the existing art. The leading end wall 58 has a shaft aperture 60, a pair of air entry apertures 62 and a slurry exit aperture 64 which opens into vacuum pipe 30.

A bearing box 65 of the drive shaft 56 is centrally supported at the trailing end of the boring head. The universal coupling 68 is located adjacent the bearing box 65 and the drive shaft 56 extends to the leading end of the head and beyond to the cutter 70. The space behind the cutter 70 is subjected to the vacuum and the slurry formed during boring enters aperture 64 in the leading end 58 of the shell and is removed continuously through the vacuum pipe 30. The water which helps to form the slurry is carried through the shell 48 by conduit 72. The water enters the drive shaft 66 via rotary coupling 74 which takes the water through a coaxial passage to multiple outlets 76 in the cutter 70.

The shaft is free to waggle in order to correct the bore direction. The shaft aperture 60 through which the shaft projects is sufficiently large to permit 15° of angular movement. Ingress of slurry into the boring head through the aperture 60 is prevented by seal 78. The adjustment of direction is achieved by suspending the shaft from two suspension points 80, 82 via a pair of double acting rams 84, 86 which are fixed to shaft sleeve 88. Between the rams is a light reflecting, aluminium target 90 showing several concentric rings. The rams are each served by conduit 92 from common mains water supply 72. Twin valve assemblies 94, 96, 98, 100 control water input to the rams and water exit from the rams which exhaust into the conduit 102. As the exhaust water from the rams is only a small intermittent volume, the conduit 102 allows the exhaust water to drain into the excavated ground.

Video camera 104 illuminates and shoots the target continuously and sends a signal to the monitor. If the bit needs to rise or fall, both rams extend or retract equally. If the bit needs to move LEFT or RIGHT, one ram extends as the other ram drains. The solenoid operated valves work on 24v dc from a joystick control on the console 44.

Figure 6:
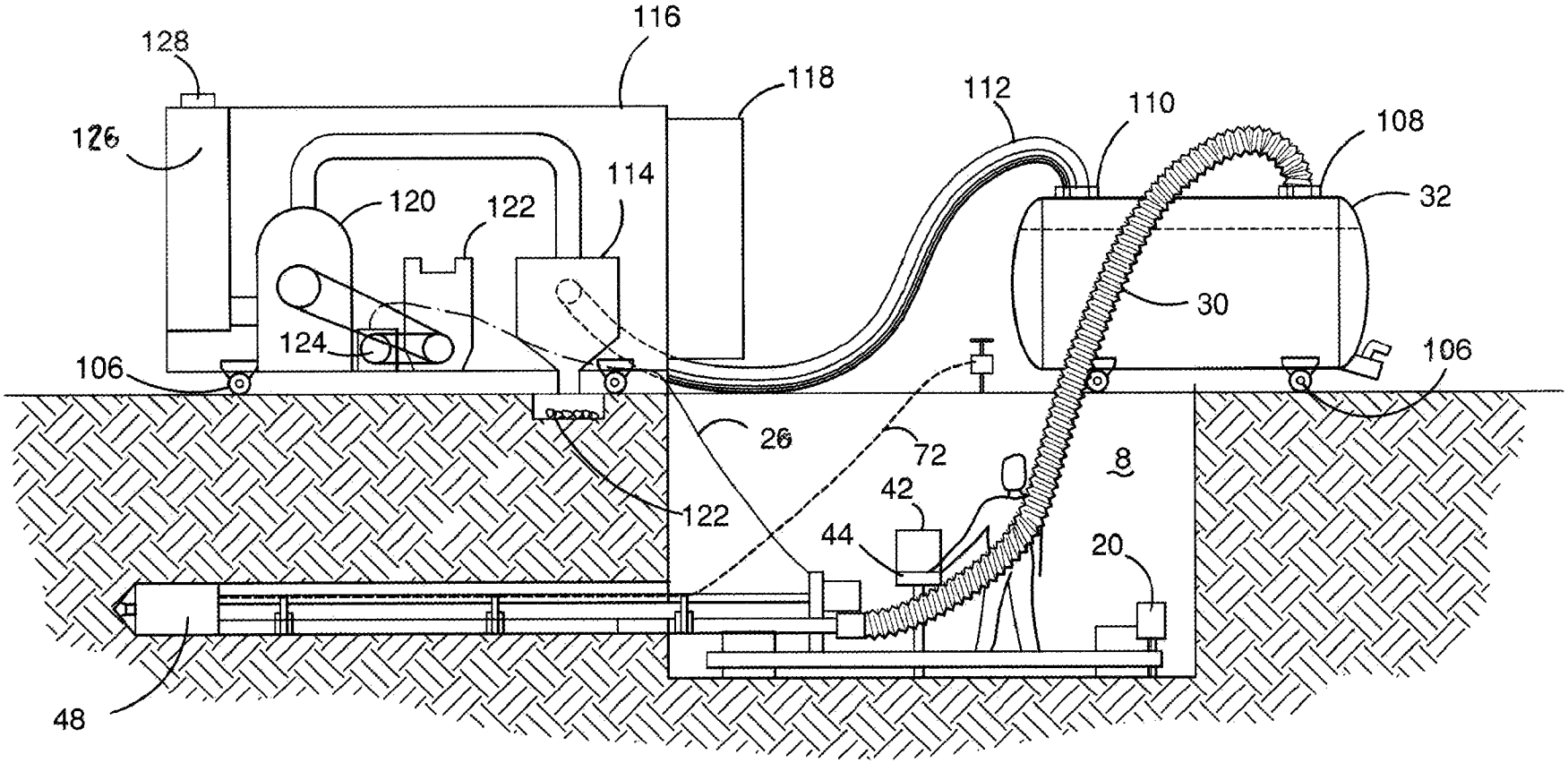
FIG. 6 shows the equipment in the field.

Referring now to FIG. 6, the vacuum tube 30 discharges airborne slurry into tank 32. The pipe 30 is five inches in diameter and the flow rate is 3000cfm. The tank 32 is of 80001 capacity. The tank is mounted on rollers 106 allowing it to be winched onto a pickup truck and exchanged for an empty replacement.

The tank has an inlet port 108 to which vacuum pipe 30 is attached and outlet port 110 from which hose 112 leads to cyclone separator 114.

The separator 114 is housed with other ancillary equipment in a cargo container 116, the rear doors 118 of which open above the pit where the operator stands. The container acts as a weatherproof housing for the equipment and is likewise mounted on rollers or skids 106 to facilitate carriage to and from the site.

Airflow for the operation is provided by an ECL 3002 liquid ring vacuum pump 120 which requires about 140 HP. This is provided by a static 240 HP Diesel engine 122. The engine also drives a hydraulic pump 124 which in turn powers the hydraulic motor 24 for the drilling operation through conduits 26. As 80% of the energy required by the vacuum pump is liberated as heat, the pump body is coupled to a radiator 126. The air discharges to atmosphere through port 128 in the container roof. Stones encountered in the drilling operation which reach the vacuum vessel but are not captured and retained by the slurry are released periodically from separator 114 and accumulate beneath the container. This tends to occur when the tank is empty at the commencement of the bore.

We have found the advantages of the above embodiment to be:

1. Ram adjustment of the shaft direction using feedwater pressure is easy and economical to build and repair.

2. Camera reporting of directional accuracy is reliable and utilizes operator time which must be paid for anyway.

3. Confining the electronics to a camera and monitor allows the operation in locations without diagnostic and repair facilities.

In a non-illustrated embodiment, the camera image supplies a digital processing unit which compares the actual direction with the required direction and issues signals for correcting the direction if necessary until the operator assumes control and gives overriding instructions. Such a modification provides a default mode which assists if the operator has to leave the monitor temporarily.

What is claimed is:

1. A system for laser-beam guidance of a microtunnelling machine comprising:

a boring head having a forward wall formed with an aperture, a boring bit forward of the forward wall of the boring head and rotatable relative to the boring head, a hollow drive shaft coupled at a forward end thereof to the boring bit and extending rearward from the boring head through the aperture in the forward wall of the boring head and a rearward end of the boring head, the aperture in the forward wall of the boring head permitting angular adjustment of the drive shaft relative to the boring head, liquid supply means for supplying water through the hollow drive shaft to the boring bit, vacuum assisted slurry removal means for creating an airstream for removing slurry from the boring bit to beyond the boring head, a target for the laser beam attached to the hollow drive shaft, a means for acquiring an image of the target and a laser strike position thereon and for conveying the image to an operator station situated remotely from the boring head, and an input means for operational adjustment of the direction of the forward end of the drive shaft, and wherein the forward wall of the boring head is formed with an air supply aperture in open communication with atmosphere for supplying air to a space forward of the forward wall and with an air removal aperture, and the vacuum assisted slurry removal means comprises a vacuum generator having a suction side, a motor connected for driving the vacuum generator, and a tube connecting the suction side of the vacuum generator to the air removal aperture, whereby the vacuum generator creates the airstream and the airstream flows through the air supply aperture to the space forward of the forward wall of the boring head, and through the air removal aperture and the vacuum tube to the suction side of the vacuum generator.

2. A system as claimed in claim 1, wherein the vacuum assisted slurry removal means includes a vacuum vessel for intercepting slurry.

3. A system as claimed in claim 2, wherein the vacuum vessel is mobile and exchangeable at the site as the operation proceeds.

4. A system as claimed in claim 1, wherein the vacuum generator is accommodated in a portable housing and driven by an internal combustion engine.

5. A system as claimed in claim 4, wherein the vacuum generator is a liquid ring vacuum pump of 2500-3500cfm capacity.

6. A system as claimed in claim 1, comprising a means for separating slurry from the airstream upstream of the vacuum generator, and wherein the vacuum generator has a pressure side through which air is discharged to atmosphere.

7. A system as claimed in claim 1, wherein the boring head is from 300 to 650 mm in diameter.

8. A system as claimed in claim 7, wherein the boring head is from 330 to 480 mm in diameter.

9. A microtunnelling machine comprising:

a boring head having a forward wall formed with an aperture, a boring bit forward of the forward wall of the boring head and rotatable relative to the boring head, a hollow drive shaft coupled at the forward end thereof to the boring bit and extending rearward from the boring head through the aperture in the forward wall of the boring head and a rearward end of the boring head, the aperture in the forward wall of the boring head permitting angular adjustment of the drive shaft relative to the boring head, liquid supply means for supplying water through the hollow drive shaft to the boring bit, vacuum assisted slurry removal means for creating an airstream for removing slurry made by the boring bit to beyond the boring head, a target for a laser beam attached to the drive shaft, a means for acquiring an image of the target and a laser strike position thereon and for conveying the image to an operator station situated remotely from the boring head, and an input means at the operator station for adjusting the direction of the forward end of the drive shaft, and wherein the forward wall of the boring head is formed with an air supply aperture in open communication with atmosphere for supplying air to a space forward of the forward wall and with an air removal aperture, and the vacuum assisted slurry removal means comprises a vacuum generator having a suction side, a motor connected for driving the vacuum generator, and a tube connecting the suction side of the vacuum generator to the air removal aperture, whereby the vacuum generator creates the airstream and the airstream flows through the air supply aperture to the space forward of the forward wall of the boring head, and through the air removal aperture and the vacuum tube to the suction side of the vacuum generator.

10. A microtunnelling machine as claimed in claim 9, wherein the vacuum assisted slurry removal means includes a vacuum vessel for intercepting slurry.

11. A microtunnelling machine as claimed in claim 10, wherein the vacuum vessel is mobile and exchangeable at the site as the operation proceeds.

12. A microtunnelling machine as claimed in claim 9, wherein the vacuum generator is accommodated in a portable housing and driven by an internal combustion engine.

13. A microtunnelling machine as claimed in claim 12, wherein the vacuum generator is a liquid ring vacuum pump of 2500-3500cfm capacity.

14. A microtunnelling machine as claimed in claim 9, comprising a means for separating slurry from the airstream upstream of the vacuum generator, and wherein the vacuum generator has a pressure side through which air is discharged to atmosphere.

15. A microtunnelling machine as claimed in claim 9, wherein the boring head is from 300 to 650 mm in diameter.

16. A microtunnelling machine as claimed in claim 15, wherein the boring head is from 330 to 480 mm in diameter.

* * * * *